United States Patent [19]

Macdonald

[11] Patent Number: 4,548,055

[45] Date of Patent: Oct. 22, 1985

[54] METHOD OF HAND-KNITTING A PATTERNED FABRIC

[76] Inventor: Anne L. Macdonald, 5606 Mohican Rd., Bethesda, Md. 20816

[21] Appl. No.: 581,893

[22] Filed: Feb. 21, 1984

Related U.S. Application Data

[63] Continuation-in-part of Ser. No. 410,005, Aug. 20, 1982, abandoned.

[51] Int. Cl.[4] ..... D04B 1/10; D04B 3/06

[52] U.S. Cl. ..... 66/1 A; 206/388; 223/107; 66/179

[58] Field of Search ..... 223/106, 107, 108; 206/372, 388, 392; 220/356; 242/146; 66/1 A, 179

[56] References Cited

U.S. PATENT DOCUMENTS

| | | | |
|---|---|---|---|
| D. 163,226 | 5/1951 | Renwick . | |
| D. 236,529 | 8/1975 | Courtney . | |
| 318,933 | 5/1885 | Turner . | |
| 623,292 | 4/1899 | Sell . | |
| 1,159,954 | 3/1915 | Kiso . | |
| 1,640,368 | 8/1927 | Obetz et al. . | |
| 2,169,297 | 8/1939 | Smith | 223/107 |
| 2,264,664 | 12/1941 | Geisman . | |
| 2,340,184 | 1/1944 | Gray | 223/107 X |
| 2,493,208 | 1/1950 | Sedgewick . | |
| 2,564,949 | 8/1951 | Bell . | |
| 2,588,540 | 3/1952 | Koistinen . | |
| 2,628,042 | 2/1953 | Fitts et al. . | |
| 3,054,277 | 9/1962 | Broschard . | |
| 3,302,903 | 2/1967 | Vogel . | |
| 3,469,687 | 9/1969 | Schnieder | 206/382 |
| 4,008,806 | 2/1977 | De Paez et al. . | |
| 4,108,397 | 8/1978 | Hauck . | |

FOREIGN PATENT DOCUMENTS

| | | | |
|---|---|---|---|
| 503554 | 6/1951 | Belgium . | |
| 938722 | 2/1956 | Fed. Rep. of Germany | 206/388 |
| 308095 | 5/1933 | Italy | 206/388 |
| 428785 | 1/1948 | Italy | 220/356 |

OTHER PUBLICATIONS

"Make It With Mademoiselle", Harmony Books, New York ©1977 Conde' Nast Pub., Inc. p. 148.

*Primary Examiner*—Werner H. Schroeder
*Assistant Examiner*—Graveline T.

[57] ABSTRACT

A method whereby patterned fabrics are knitted from plural sources of colored yarn without tangling of the yarn strands or need for repositioning the yarn sources during knitting by providing a yarn source holder for disposing a plurality of yarn balls in a linear array wherein the yarn strands are twisted during the knitting of the knit row and untwisted during the knitting of the purl row while maintaining the holder in a substantially stationary position.

4 Claims, 5 Drawing Figures

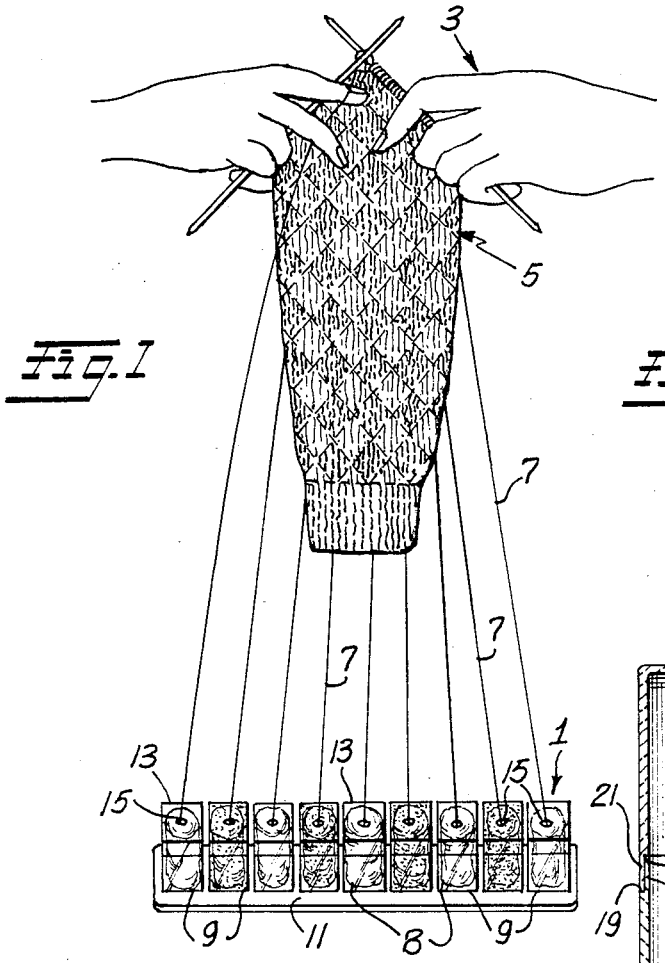
Fig. 1
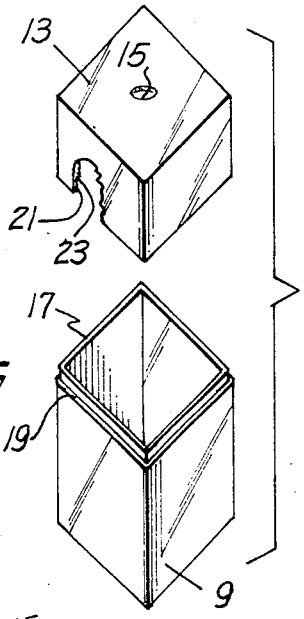
Fig. 5
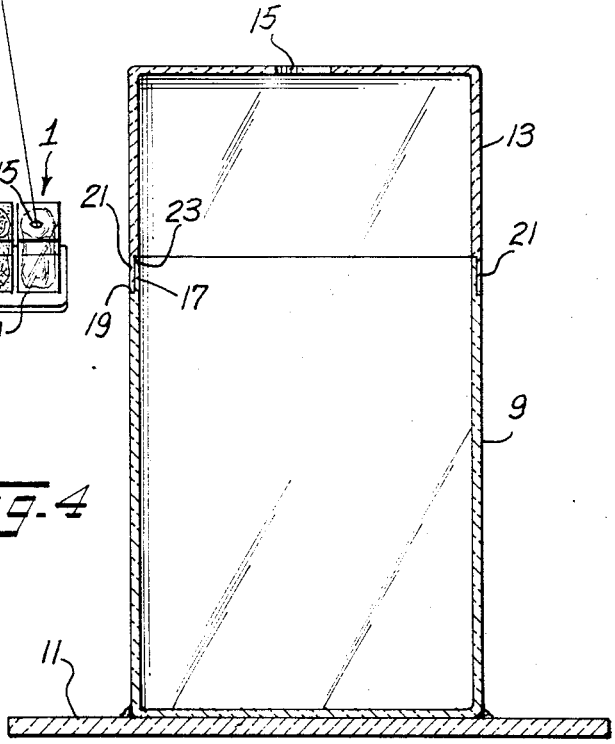
Fig. 4
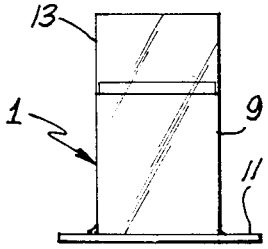
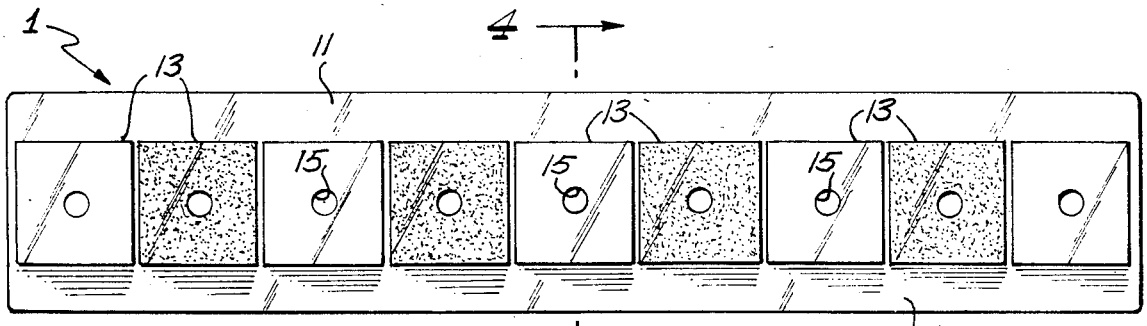
Fig. 3

METHOD OF HAND-KNITTING A PATTERNED FABRIC

CROSS REFERENCE TO RELATED APPLICATION

This application is a continuation-in-part of application Ser. No. 410,005, filed on Aug. 20, 1982, abandoned.

BACKGROUND OF THE INVENTION

1. Field of the Invention

The present invention generally involves the hand-knitting of fabrics. More specifically, the invention relates to an improved method of securing, feeding and knitting plural sources of yarn to produce a patterned fabric.

2. Description of the Prior Art

The hand-knitting of fabric having a variegated pattern, such as an argyle or plaid pattern, requires plural sources of different colored or shaded yarns which must be available for continual use as each yarn strand is sequentially incorporated into the fabric during knitting. The knitter must introduce each strand of yarn from its source as each new color is incorporated into the fabric, with this being accomplished in such a manner so as to form no gaps between the colors.

The actual procedure of hand-knitting a patterned fabric requires that the knitter first proceed across a knit row, adding each new color from an appropriate yarn source and with each new yarn strand being brought up from underneath and then passed over the previously used yarn strand as the stitch is made. This latter procedure of "twisting" the yarn provides a firm transition from one color to another. When the knit row is completed and the respective colored yarn strands have been incorporated into the fabric, the knitter must then rotate the knitting needles clockwise so that a purl row can be started working from right to left. Working the purl row, the knitter again brings the new yarn strand up and over the previously worked strand, thereby again completing a twist.

Because of the plurality of yarn sources required in this form of knitting a patterned fabric, the prior art has proposed various devices and accessories to facilitate the manipulation of the yarns so that there will be less tangling than occurs when the sources are left to dangle on bobbins. Some devices require that the individual yarn sources be supported on spools, but this arrangement requires manual unwinding, exposing the yarn sources to soiling, and does nothing to reduce actual tangling of the yarn strands. Another prior art approach involves the disposition of plural yarn balls together in a common, partitioned container, an arrangement which maintains the yarn sources in a clean condition, but nevertheless requires the manipulation of the yarn sources themselves when twists are made during the knitting process. Still another type of known device separates the yarn strands through a comb-like device, but still maintains the yarn sources supported on bobbins disposed below the "comb".

None of the heretofore known prior art devices teach the combination of storing individual yarn sources in separate discrete containers having individual tightly fitting lids, disposing the containers and yarn sources in a linear array in the exact sequence in which they will appear in the knitted fabric, supporting the containers on a common base, and permitting the knitting of a patterned fabric wherein the knitter is not required to handle or manipulate the individual yarn sources during the knitting process. This highly desirable combination of factors serves to render possible the knitting of a patterned fabric in which yarn strands that are twisted on a knit row shall be untwisted on a purl row.

Some examples of the aforedescribed prior art devices for facilitating the hand-knitting of patterned fabrics from plural yarn sources are disclosed by the Geisman U.S. Pat. No. 2,264,664, Sedgewick U.S. Pat. No. 2,493,208, Fitts et al. U.S. Pat. No. 2,628,042, Broschard U.S. Pat. No. 3,054,277 and DePaez et al. U.S. Pat. No. 4,008,806.

SUMMARY OF THE INVENTION

It is an object of the present invention to provide an improved method of facilitating the hand-knitting of patterned fabrics.

It is another object of the invention to provide an improved device and method of knitting a fabric wherein a plurality of different yarn balls of different colors are stored and dispensed in the exact sequence that the colors appear in the finished fabric.

It is a further object of the invention to provide an improved method of storing and dispensing yarn in a method of knitting a patterned fabric from a plurality of individual yarn sources by which the tangling that occurs during the "twisting" of the yarn strands is automatically reversed and untangled without the need for manipulating the yarn sources during knitting.

It is still a further object of the invention to provide an improved device for facilitating the hand-knitting of patterned fabrics wherein the device is simple in construction, easy to use and economical to manufacture.

These and other objects of the invention are achieved through an improved method of hand-knitting a patterned fabric by providing a device for storing and dispensing a plurality of individual yarn balls wherein the device is defined by a plurality of discrete separate containers disposed in a linear array and secured to a common support base. Each container is preferably rectangular or box-shaped and includes a snug fitting removable cover with an aperture through which a yarn strand may be dispensed from a yarn ball freely supported in the container. The container substantially fully encloses the yarn balls contained therein to prevent soiling of the yarn balls and tangling of the individual yarn strands being dispensed. The containers and covers are preferably made of transparent plastic to permit viewing the yarn balls for color and identification and ascertaining the amount of yarn remaining on each ball. It is further preferable that alternate containers be identified, such as by tinting, so that contrasting colored yarns can be disposed in clear containers while background colored yarns are disposed in the tinted containers, thereby affording the knitter with immediate visual orientation of the different yarns. The cover of each container is slidably and tightly fitted onto its associated container, with individual containers being spaced at a sufficient distance from each other to facilitate removing and adding individual yarn balls without disturbing adjacent yarn sources.

Other objects, advantages and aspects of the invention and the various features of construction shall become apparent to those skilled in this art upon reference to the following specification and accompanying drawings forming a part hereof.

BRIEF DESCRIPTION OF THE DRAWINGS

FIG. 1 is a perspective view depicting the knitting of a patterned fabric, specifically an argyle sock, according to a preferred embodiment of the present invention;

FIG. 2 is an end view of the device used to practice the invention as shown in FIG. 1;

FIG. 3 is a top view of the device shown in FIG. 2;

FIG. 4 is a sectional view taken along the line 4–4 of FIG. 3; and

FIG. 5 is an exploded perspective view, shown partly in section, of an individual container and its associated cover, of the device shown in FIG. 2.

DETAILED DESCRIPTION OF THE PREFERRED EMBODIMENTS

A device 1 is shown in FIG. 1 in use by a knitter, indicated generally at 3, in the knitting of a patterned fabric 5 according to a preferred embodiment of the present invention. Fabric 5 may be an argyle sock or similar article. Device 1 is preferably supported in a substantially stationary position on the lap of knitter 3 who performs the knitting process in a seated position in order to facilitate continual and sequential dispensing of a plurality of yarn strands 7 from a plurality of yarn balls 8 contained in device 1.

Yarn balls 8 are of varying colors and shades which collectively determine the final pattern of fabric 5. While device 1 is shown as including provision for storing nine yarn balls 8 and dispensing a corresponding number of yarn strands 7 therefrom, it is understood that device 1 can be expanded or reduced in size in accordance with the teachings set forth herein to store and dispense any number of yarn balls 8, depending upon the nature and type of fabric 5 being kintted.

The details of device 1 shall now be described with particular reference to FIGS. 2 and 3. As seen, device 1 includes a plurality of discrete and separate containers 9, disposed and spaced in a linear array and having their bottoms secured to a support base 11. Each container 9 is of a rectangular box-shaped configuration and provided with an associated cover 13 which is slidably and snugly fitted onto container 9 in a particular manner to be later described. With specific reference to FIG. 3, it is seen that each cover 13 is provided with an aperture 15 for the purpose of dispensing yarn strands 7 therethrough.

It is preferred that device 1, including at least each container 9 and its associated cover 13, be entirely made from transparent plastic material to permit the viewing of individual yarn balls 8 stored in containers 9. As also shown in FIG. 3, by making alternate containers 9 of clear plastic material and remaining containers 9 of tinted plastic material, knitter 3 may orient yarn balls for contrasting colors required in the knitting of fabric 5.

The use of plastic material for making device 1 greatly simplifies the manufacturing process and results in an economical product that is strong, light in weight and easy to manipulate during the knitting process. Should support base 11 be also made of the same plastic material used in making containers 9, containers 9 may then be secured to base 11 through the use of appropriate adhesive or any other technique well known in the art for connecting plastic members together.

The details of container 9 and its associated cover 13 shall now be described with particular reference to FIGS. 4 and 5. Container 9 and cover 13 collectively define a rectangular-shaped box having a smooth exterior surface, with both container and cover 13 sharing an identical transverse cross-sectional configuration. The manner in which cover 13 is removably secured to container 9 is important inasmuch as this engagement must not only be easy to accomplish, but also remain snug against accidental removal of cover 13 during the knitting process. These requirements are realized by providing the outer peripheral surface of container 9 with an inward flange 17 of reduced thickness and an associated outward ledge 19. Similarly, cover 13 is provided around its open peripheral edge with an outward flange 21 of reduced thickness and an associated inward ledge 23. As is therefore apparent, this arrangement permits cover 13 to be slidably fitted onto container 9 until the terminal end of its inward flange 17 engages inward ledge 23 and the terminal end of outward flange 21 engages outward ledge 19. The thickness of inward flange 17 corresponds to the width of inward ledge 23. Similarly, the thickness of outward flange 21 corresponds to the width of outward ledge 19.

As seen in FIG. 4, when cover 13 is fully engaged on container 9, both the interior and exterior wall surfaces of cover 13 and container are in smooth coplanar disposition with respect to each other. This permits freely disposing yarn ball 8 within container 9 without the need of supporting yarn ball 8 on a spool. Accordingly, yarn strand 7 is therefore permitted to be freely dispensed through aperture 15 of cover 13 without tangling in itself or with other yarn strands 7 supported by device 1. The slidable engagement between cover 13 and container 9 has been shown to be snug and secure against accidental removal of cover 13 during the knitting process. However, cover 13 may easily be intentionally removed by knitter 3 when it is desired to change or replenish yarn ball 8.

Device 1 provides an extremely simple and yet effective means for facilitating the hand-knitting of patterned fabric from a plurality of yarn sources in an efficient manner. The minimum weight of device 1 greatly facilitates its manual manipulation. Yarn balls 8 are conveniently stored in device 1 in a manner that permits free dispensing of their respective yarn strands 7 without tangling, notwithstanding the number of yarn strands being dispensed. The construction of device 1 from transparent plastic material, preferably wherein containers 9 and covers 13 are formed from alternating clear and tinted plastic material, facilitates observing the extent of yarn supply remaining as well as providing instant visual orientation of different yarns for contrasting and background colors.

MODE OF OPERATION

A preferred method of practicing the invention for utilizing aforedescribed device 1 shall now be detailed. Knitter 3 first winds the necessary number of colored yarn balls for the fabric to be knitted so that each yarn strand feeds from the inside of its corresponding yarn ball to provide a free and continual flow of yarn. A yarn ball 8 of selected color is then disposed in each container 9 in the same sequence that the selected colors shall ultimately appear in the finished fabric. Individual yarn strands 7 are then drawn through apertures 15 of their corresponding covers 13, after which covers 13 are snugly fitted onto containers 9. Knitter 3 thereafter proceeds with the actual knitting process by first knitting a knit row from yarn strands 7 wherein each succeeding yarn strand 7 is lifted up and over the previous yarn strand 7, thereby twisting same. When the knit row has been completed, knitter 3 then turns the knitted fabric 180° and works a purl row, again lifting each succeeding strand 7 up and over previously used strand 7. This action, accomplished while maintaining device 1 in a substantially stationary position, adjacent to or on the lap of knitter 3, shall automatically cause the untwisting of the yarn strands that were previously twisted on the knit row. As the knitter again prepares to undertake another knit row by returning the knitted fabric 180° to its original position, it shall be apparent that the yarn strands are once again in their original parallel position.

The invention only requires that knitter 3 manipulate yarn strand 7 during the knitting process, without the necessity of manipulating yarn balls 8 since the latter are securely enclosed within their individual containers 9. The only purpose for handling yarn balls 8 by knitter 3 would be to replenish the yarn sources, change the color of a desired pattern or correct a knitting error.

It is to be clearly understood that the embodiments of the invention herein shown and described are to be taken as merely preferred examples of the same, and that various changes in the shapes, sizes, arrangement of parts, compositions and methods of use and operation may be resorted to, without departing from the spirit of the invention or scope of the subjoined claims.

I claim:

1. An improved method of hand-knitting a patterned fabric from plural sources of colored yarn without permanent tangling of the yarn strands or need for repositioning the yarn sources during knitting, which method comprises the steps of:

a. providing a yarn source holder including a plurality of discrete containers disposed in a linear array and supported on a common base, with each container having a snug fitting cover with an aperture therethrough;

b. disposing a yarn ball of selected color in each container in the same sequence that the selected color shall appear in the finished fabric;

c. withdrawing the individual yarn strands through the apertures of their corresponding covers and securing the covers on their corresponding containers;

d. working a knit row from the yarn strands wherein each succeeding yarn strand is lifted up and over the previous yarn strand to twist the strands;

e. turning the knitted fabric 180°;

f. working a purl row from the yarn strands wherein each succeeding yarn strand is lifted up and over the previous yarn strand to twist the strands;

g. turning the knitted fabric 180° to return it to its original position;

h. alternating steps d,e,f and g while maintaining the yarn holder in a stationary position and without manipulation of the yarn sources so that the yarn strands that are twisted during the working of a knit row are untwisted during the working of a purl row.

2. The method of claim 1 wherein at least the containers are each made of transparent plastic material.

3. The device of claim 1 wherein at least the covers are each made of transparent plastic material.

4. The method of claim 1 wherein the containers are alternately made of clear and tinted plastic material.

* * * * *